US005253449A

United States Patent [19]

Webb et al.

[11] Patent Number: 5,253,449

[45] Date of Patent: Oct. 19, 1993

[54] DETACHABLE FINISHING BLADE FOR EXCAVATING BUCKET

[76] Inventors: Kenneth W. Webb, 5609 N. Heatherstone, Shreveport, La. 71129; Steven W. Pohl, 10038 Gordord Rd., Bethany, La. 71007

[21] Appl. No.: 952,057

[22] Filed: Sep. 28, 1992

[51] Int. Cl.[5] ..... E02F 3/76

[52] U.S. Cl. ..... 37/446; 37/468; 37/444; 37/450

[58] Field of Search ..... 37/117.5, 103, DIG. 3, 37/DIG. 12, 141 R, 118 R

[56] References Cited

U.S. PATENT DOCUMENTS

| | | | |
|---|---|---|---|
| 3,765,109 | 10/1973 | Daviduke | 37/141 R |
| 3,775,879 | 12/1973 | Quick | 37/118 R |
| 3,795,070 | 3/1974 | Bronson et al. | 37/117.5 |
| 3,942,271 | 3/1976 | George | 37/141 R X |
| 4,009,529 | 3/1977 | Johnson | 37/141 R X |
| 4,043,060 | 8/1977 | Stepe | 37/DIG. 12 X |
| 4,271,614 | 6/1981 | Albrecht | 37/103 |
| 4,360,980 | 11/1982 | Jarvis | 37/DIG. 12 X |
| 4,467,539 | 8/1984 | Gurries | 37/141 R X |
| 4,550,512 | 11/1985 | Felstet | 37/117.5 |

*Primary Examiner*—Randolph A. Reese
*Assistant Examiner*—J. Russell McBee
*Attorney, Agent, or Firm*—Pravel, Hewitt, Kimball & Krieger

[57] ABSTRACT

An improved excavating bucket, having a pair of sidewalls, a rear wall, a floor portion and an open front portion for receiving material thereinto; a plurality of teeth members secured to the floor portion for digging into the material to be excavated; a finishing blade mounted to the bucket, the blade extending across a width greater than the width of the bucket opening, and having a forward edge for scraping; a raised channel formed on the upper face of the blade for engaging a plurality of the teeth members; sidewall members extending from the outer edges of the blade for engaging the wall of the bucket, for defining an uninterrupted travelling space for material into the bucket; and adjustable support rods able to be swivelly positioned between the blade and the bucket sidewalls to stabilize the blade mounted on the bucket.

9 Claims, 5 Drawing Sheets

DETACHABLE FINISHING BLADE FOR EXCAVATING BUCKET

BACKGROUND OF THE INVENTION

1. Field of the Invention

The apparatus of the present invention relates to excavating buckets. More particularly the present invention relates to a detachable finishing blade which can be easily positioned on different size excavation buckets and allow for the finishing of broad areas excavated, and allow movement of a greater capacity of material into the bucket.

2. General Background

In excavation of land utilizing a backhoe or the like apparatus, the backhoe is equipped with an excavation bucket, which in general comprises a bucket-shaped scoop mounted at the end of the arm of the backhoe, the bucket having a plurality of excavating teeth protruding from its bottom wall, so that it can excavate the land area, or the like, and move fill into the bucket for disposal, etc. Excavating buckets are also utilized to help complete an excavation project, following the filling of a ditch or pit, by smoothing out the dirt, packing it in, or scraping off the excess fill to flatten the area.

One of the shortcomings of the state of the art excavation bucket is the inability of the bucket to be easily utilized on the finishing work following excavation. Usually, the bucket, or the teeth on the front of the bucket have to be replaced by a blade so that the blade can be utilized to form a smooth finished surface as the blade is moved along the ground in the finishing method.

However, in the art, there is no system of excavation buckets which allows the easy adaptation of a typical excavation bucket by the attachment of a blade onto the front of the bucket, so that the bucket can be used to finish excavation and yet allow materials to continue to be loaded into the bucket following adaptation of the blade unit.

The prior art which was found as a result of a patentability search is being submitted herewith as part of the Art Statement and is incorporated herein by reference thereto.

Other objects of the invention will be obvious to those skilled in the art from the following description of the invention.

SUMMARY OF THE PRESENT INVENTION

The apparatus of the present invention solves the problems in the art in a simple and straight forward manner. What is provided is an improved excavating bucket, having a pair of sidewalls, a rear wall, a floor portion and an open front portion for receiving material thereinto; plurality of teeth members secured to the floor portion for digging into the material to be excavated; a finishing blade movably mounted to the bucket, the blade extending across a width greater than the width of the bucket opening, and having a forward edge for scraping; a raised channel formed on the upper face of the blade for engaging a plurality of the teeth members;

sidewall members extending from the outer edges of the blade for engaging the wall of the bucket, for defining an uninterrupted travelling space for material into the bucket; and adjustable support sleeves positioned between the blade and the bucket sidewalls to stabilize the blade on the bucket.

Therefore, it is a principal object of the present invention to provide an excavation bucket adapted with a finishing blade so that the bucket can be easily used to finish a job, and continue to function as an excavation bucket;

It is a further object of the present invention to provide a finishing blade for an excavation bucket which can be secured to the teeth of the bucket, and held in place by adjustable sleeves to allow the bucket to function as a finishing tool;

It is a further object of the present invention to provide a finishing blade system attachable to a standard excavation bucket, so that the blade can be removed easily, yet while in place held secure to undertake finishing jobs, and adjust to various size buckets; and It is a further object of the present invention to provide a system for mounting a finishing blade on an excavation bucket which provides for a swivel mounting feature so that the blade can be mounted on different size buckets.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
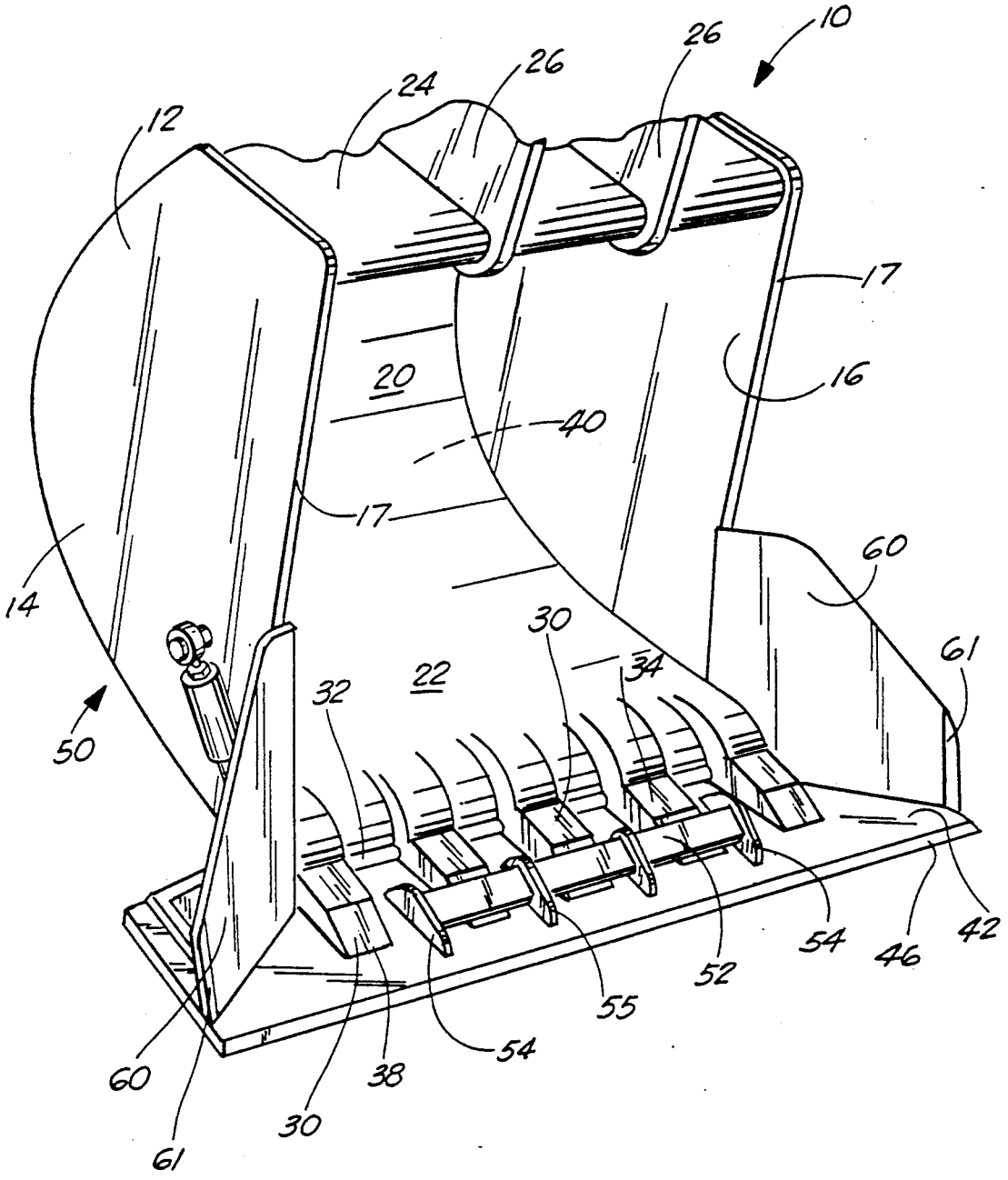
FIG. 1 illustrates an overall view of the preferred embodiment of the present invention.
Figure 2:
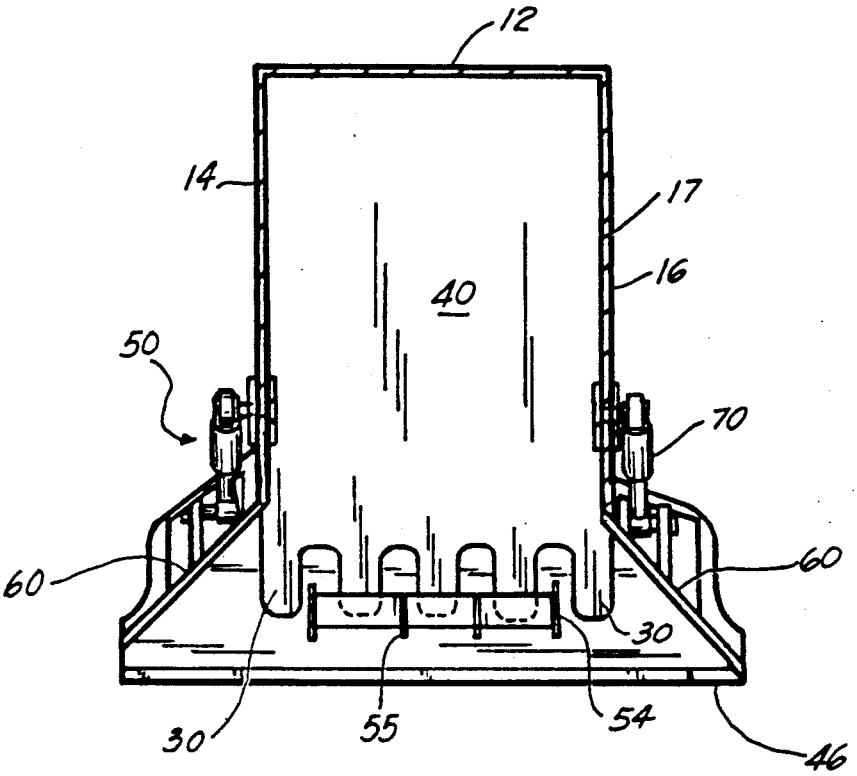
FIG. 2 illustrates an overall top view of the preferred embodiment of the present invention.

FIGS. 1 through 10 illustrated the preferred embodiment of the present invention by the numeral 10. As illustrated in overall view in FIG. 1, apparatus 10 comprises an excavating bucket 12, of the type having a pair of upright side walls, 14, 16, a curved base portion 18, which extends from a rear upright portion 20, to the floor 22 of the bucket. There is further provided an upper portion 24, for connectedly engaging the bucket 12 to the arms 26 of a backhoe (not illustrated) or the like implement to excavate earth or the like material. Further, the excavating bucket 12 includes a plurality of excavating teeth members 30, along the front edge 32 of the floor 22, with each of the teeth members extending therefrom, and spaced apart to form the plurality of digging means. Each tooth includes a body portion 34 secured through welding or the like to the front edge 32 of floor 22, and terminate in a beveled edge 36 to form a point 38 that excavates the earth. The bucket as illustrated in FIG. 1 also defines a space 40, formed by the floor portion, and side walls, wherein materials excavated are moved into for clearing out the area.

As further illustrated in FIG. 1 in overall view is the means for transforming the excavating bucket 12 to a finishing implement, of the type to spread the upper level of dirt into a smooth layer, and to finish the edges of the area. This means includes a blade 42, extending from a distance greater across than the width of the bucket 12 itself, for defining a finishing blade there across. Further blade 42 includes a beveled front edge 44 to form the means to finish the surface very smoothly. Blade 42 would also include an under surface 46, which would be flat, and would allow for the packing of the smooth, finished area.

The blade 42 is mounted to the excavation bucket 12 through a unique mounting system 50 which allows for the secure mounting so the blade can be secure when in use, and provides for easy mounting and removal from the bucket 12. Further the manner in which the blade is mounted allows full access to the space 40 within the bucket 12 so that materials may still be moved into space 40 even with blade 42 mounted onto the bucket 12.

Figure 9:
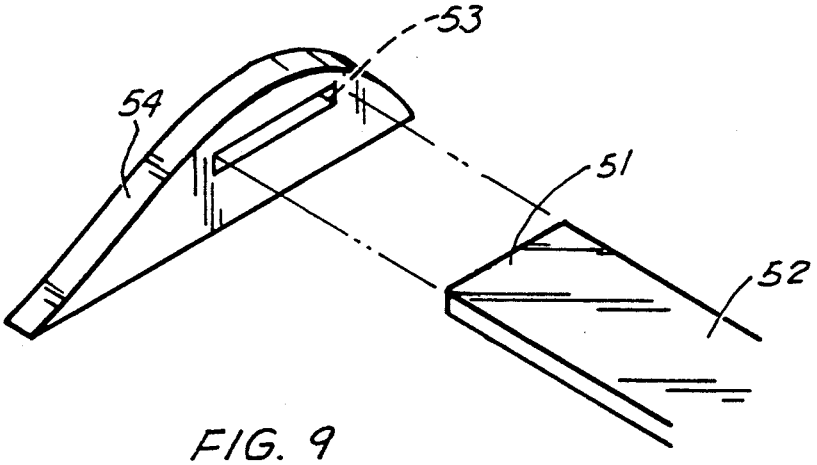
FIG. 9 illustrates a partial view of the plate utilized for engaging the tooth members in the mounting of the blade.

The mounting system 50 would further comprise an upper mounting plate 52, secured to upper surface 43 of blade 42, comprising a pair of end mounting members 54, welded or the like along the blade 42, and providing that plate 52 is raised from the upper surface 43 of plate 42, for defining a receiving space 56 therein. Preferably, as seen in FIG. 9, the end of plate 52 would have a lip 5 received into an opening 53 in mounting members 54, to hold it securely in place. Receiving space 56 would receive the beveled edge 36 of a plurality of the teeth 30 from bucket 12, so that the blade, when secured as seen in the figures, is centrally positioned along the front of bucket 12. Preferably, as seen in FIG. 1, the central most teeth 30 would be secured within the space 56, with the outer most teeth set free. There would be further provided additional front support gussets 55 spaced apart along the top of plate 52, and extending forward of plate 52 welded to the upper surface 43 of plate 42, so that the materials moving over plate 52 slide along the upper surface 57 of the members 55, and do not contact plate 52.

The mounting system would further comprise a pair of side walls 60 extending between the upper surface 43 of plate 42 and the front edges 17 of each side wall 14, 16 of bucket 12, so as to define a means to assure that the materials scraped by plate 42 during the operation, are channeled from the surface of the plate inwardly to the reduced opening in the space 40 of bucket 12. As illustrated in the figures, it is preferable that the position of side walls 60 be slightly tilted to the rear, so that the materials do not encounter a upright plate barrier, but are eased into the bucket space 40 by the rear-tilted side walls 60. In addition, each side wall 60 would provide a side cutter 61 mounted on the front edge of the wall, as seen in FIG. 1, which would, like the edge 44 of blade 42 act as a cutting surface. The edge 61 would be welded to the front edge of the side wall 60, and would be of hardened steel or the like material.

Figure 10:
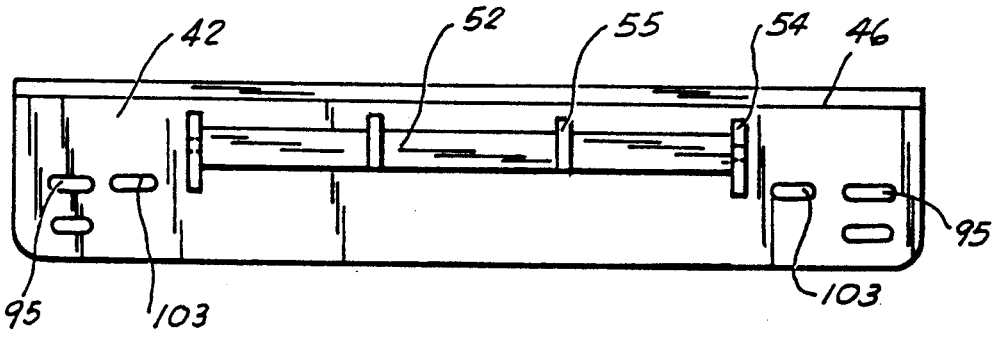
FIG. 10 is a top view of the blade to be utilized in the preferred embodiment of the present invention.

FIGS. 2 through 6 illustrate in detail the mounting system which has been heretofore described, and the additional mounting system which is unique to the apparatus. As illustrated, for example in FIG. 5, the side walls 60, are mounted to the blade 42 via a mounting plate 67 which would in turn bolting engage to blade 42. As illustrated, this is accomplished by a first elongated mounting slot 93 which would engage a first transverse mounting slot 95 on blade 42. There would be further provided a pair of mounting slots 97, 99 on plate 67 to accommodate a pair of bolts 101 through a second transverse slot 103 of blade 42. Blade 42 may have additional transverse slots as illustrated in FIG. 10. In this manner the bolting between the mounting plate 67 and the blade 42, through the sloted openings allows the blade to be accomodated onto a variety of widths of excavating buckets. That is, once the blade is positioned via the teeth 30 of the bucket fitted into receiving space 56, the side walls would be fitted against the edge of the bucket, and once the alignment is complete, the bolts 101 are tightened, and the side walls are in place. Further, it should be noted that the side walls are further supported by a pair of gusset plates 64 and 65 mounted to plate 67, so as to help support the side walls 60. This means is clearly shown in the figures, particularly FIGS. 4 through 7.

Figure 5:
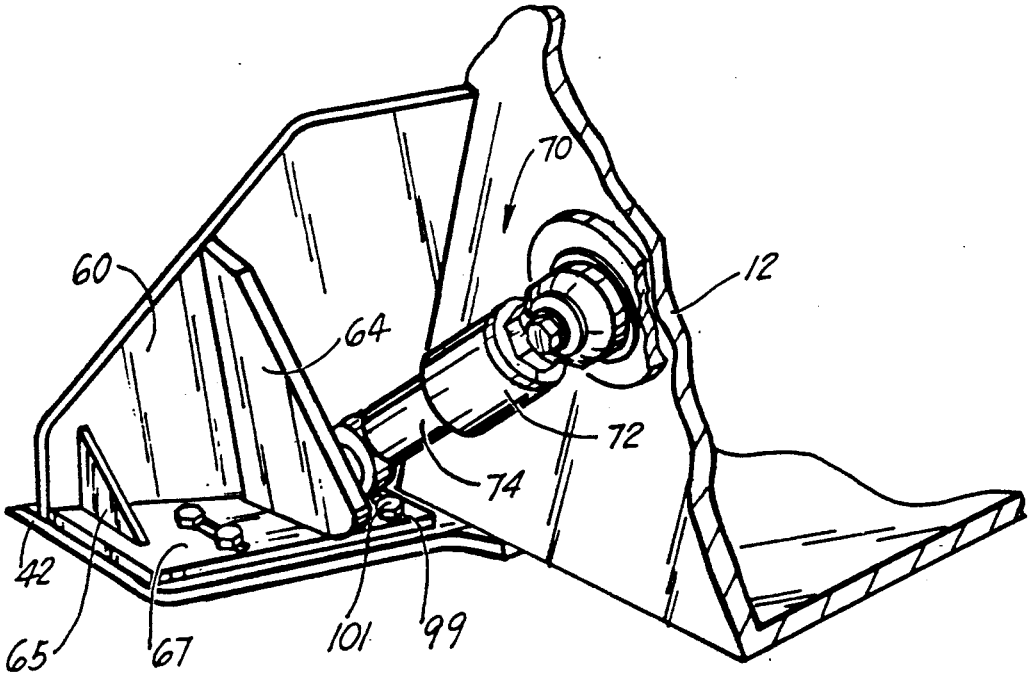
FIG. 5 illustrates an overall view of the mounting sleeve utilized in the preferred embodiment of the present invention.
Figure 4:
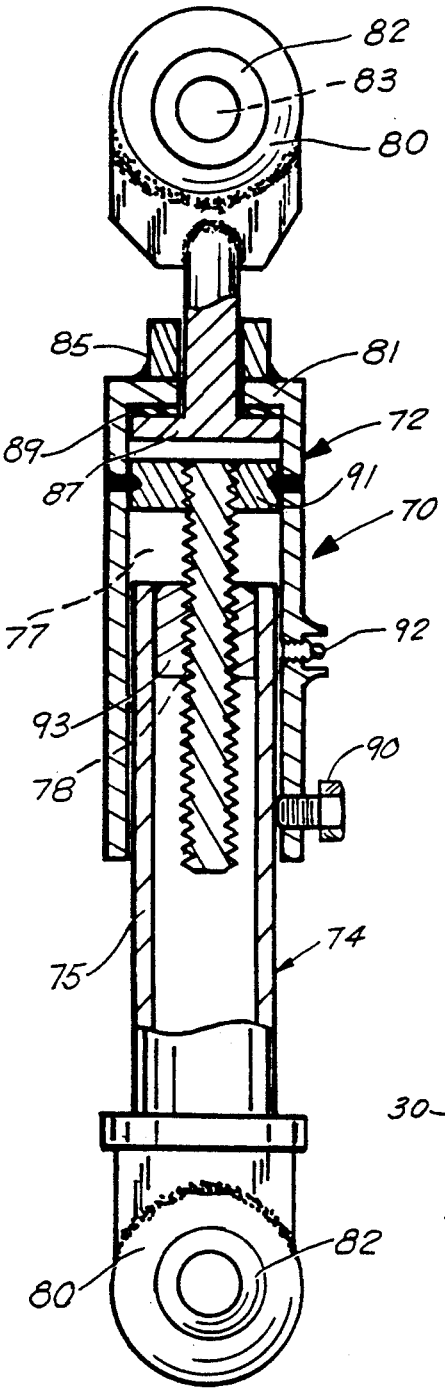
FIG. 4 illustrates an overall cutaway view of the mounting sleeve utilized in the preferred embodiment of the present invention.
Figure 3:
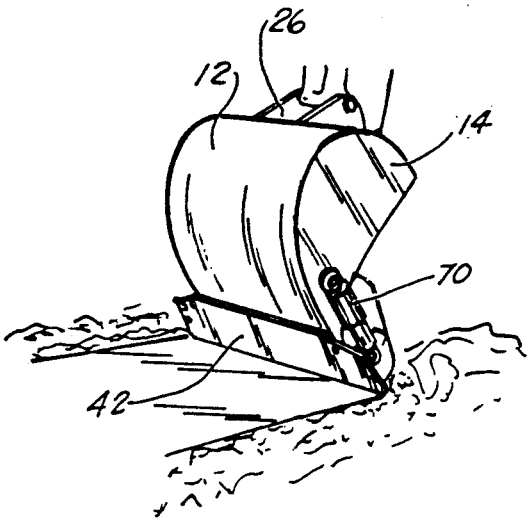
FIG. 3 illustrates an overall view of the preferred embodiment of the present invention during a finishing procedure.
Figure 7:
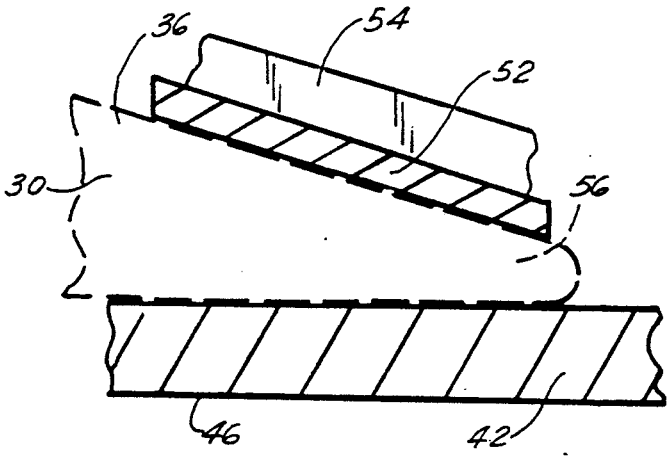
FIG. 7 illustrates a partial side view of the blade mounted onto an excavation bucket tooth member in the preferred embodiment of the present invention.
Figure 6A:
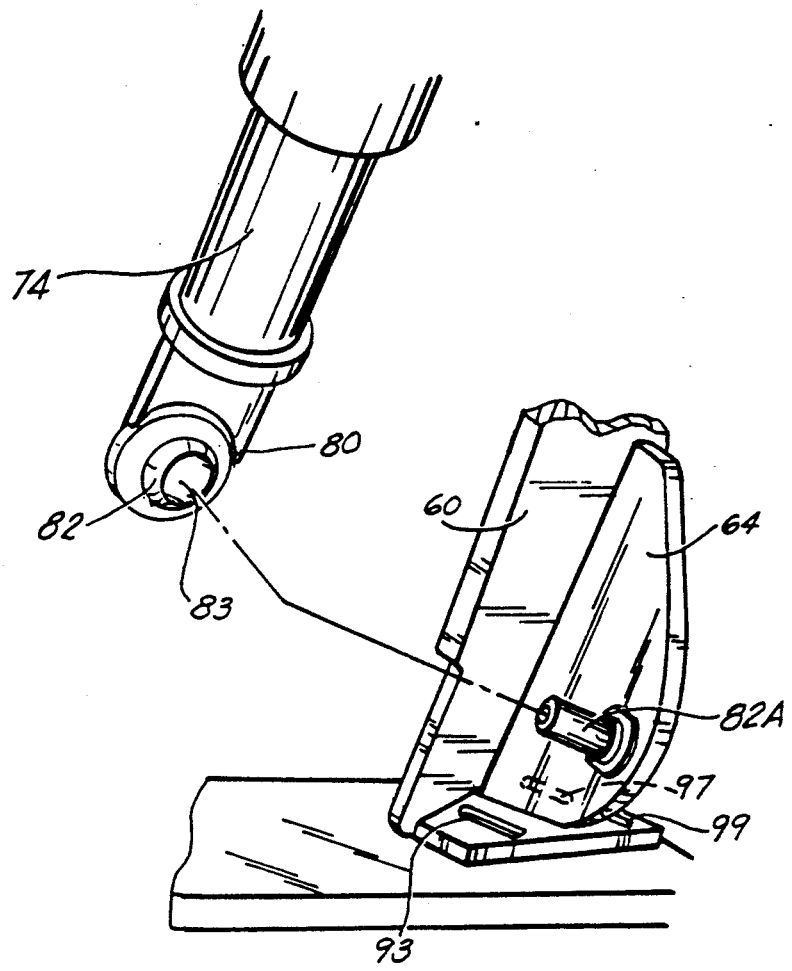
FIGS. 6A and 6B illustrate partial views of the mounting sleeves utilized in the preferred embodiment of the present invention.
Figure 6B:
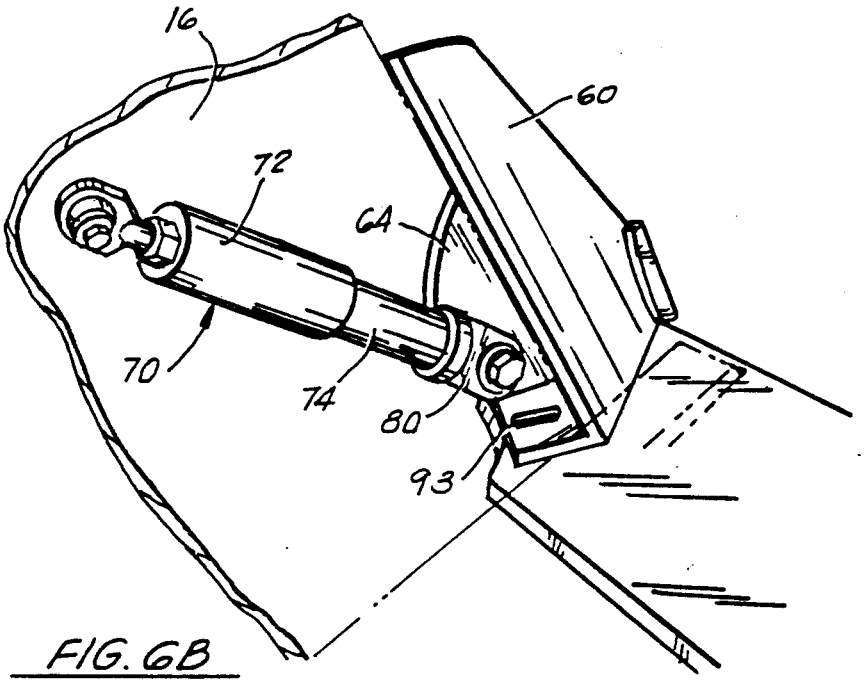
Figure 8:
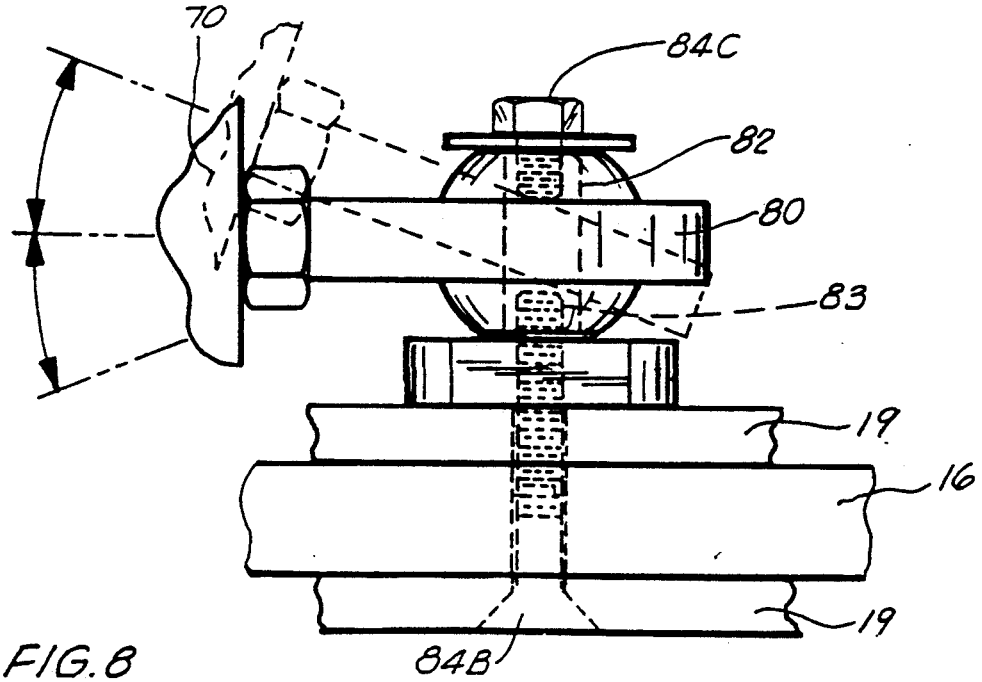
FIG. 8 illustrates a partial view of the mounting rod showing further the swiveling of the rod mounted in place.

As seen in FIG. 5, there is illustrated an additional connection means which comprises a generally elongated mounting rod 70, extending from each gusset plate 64, positioned on each side of the blade 42, and each side wall 14, 16 of bucket 12. In operation, the mounting rods 70 provide stability, yet provide a means to allow the blades to be positioned upon various sizes of buckets 12, and provide for some movement between the connections. Overall, as seen in FIG. 4, the mounting rod 70 in reality comprises a series of inter-working parts. There is provided a first upper section or outer housing 72 and a second lower section 74, with the body 75 of section 74 moving into the space 77 defined by housing 72. Further there is provided a mounting means, or padeye 80, having a ball joint 82, at each end to define the entire mounting system 70. One padeye 80 would be secured to the lower housing 74 through welding of the like and would include a ball joint 82 in padeeye 80 so that a gusset pin 84 secured to the gusset plate 64, as seen in FIG. 6A, could be inserted through the port 83 in ball joint 82 and securely mounted to padeye 80. The upper housing 72 would likewise have padeye 80 mounted on its end, housing a ball joint 82 for inserting a mounting bolt 84A through port 83 in ball joint 82 and securely mounting the upper end of the rod to the walls 14, 16 of bucket 12. As seen in FIG. 8, the walls 14, 16 of bucket 12 would be reinforced with plates 19, with the head 84B of bolt 84A recessed within plate 19 to avoid contact with material in bucket 12.

However, in this case, padeye 80 would be able to rotate free of body section 72. The means for accomplishing this would be a post 85 welded or threaded onto padeye 80, and extending through the upper wall 81 of body 72. The second end of post 85 would be attached to a base member 87 would be positioned within the space 77 of housing 72, and would rotate freely within space 77, with post 85 serving as the axis of rotation. To reduce the wear between the upper wall 81 of body 72 and base member 87 there would be provided a wear bushing 89, of nylon or the like material, to provide more wear and easier rotation.

Of course, the upper housing 72 must be engaged to lower housing 74. The means for accomplishing this is provided by a central bolt member 76 extending down the length of upper body 72, with the end of the bolt secured within body 72 by a mounting bushing 91 mounted onto the wall of the body 72 via welding or the like. The bolt 76 would thread into a nut 93 welded into the housing space within lower housing 74, so that rotation of housing 72 would thread bolt 76 into nut 93, to reduce or increase the length of the mounting sleeve as required, yet allow the two padeyes 80 mounted on each end to remain securely attached to the gusset plate 64 and to the wall 16 of bucket 12.

Following the mounting procedure, once each end is secured in place, the free rotation of the housing 72 would impart rotation to bolt 76 within threaded port 78, and depending on the rotation of housing 72, would provide for the extension of the retraction of the overall length of rod 70. This is necessary, since the blade 42 may be mounted to various size buckets, and would require that the rod 70 have the capability to retract and extend as required. It should be noted, also, that the configuration of the housing 72 around the threaded bolt 76 provides for protection of the bolt from outside knocks of the like. Further, since each padeye 80 includes a ball joint 82, this allows for some swiveling movement of the mounting rod 70 of the between the blade 42 and the bucket 12, as seen in phantom view in FIG. 8, rather than having a rigid attachment, which allows for accomodating varied bucket widths. As seen further in the figures, once the rod 70 has been properly adjusted, there is provided a set screw 90 in the wall of housing 72, so that when secured, prevents further rotation of housing 72, until desired. Further is provided a grease fitting 92 on the wall of housing 42 so that grease may be injected in to the housing to prevent rusting or corrosion of the internal connections between the body portions of rod 70.

In most cases, when the blade 42 is secured to the bucket 12, the walls 14, 16 of bucket 12 will be accommodated with holes so that the rod 70 may be secured therethrough. However, in certain instances, a hole may have to be drilled into a bucket wall to accommodate the mounting bolt, and when this is done, the hole is prepared to accommodate the mounting bolt for proper installation.

Glossary of terms apparatus 10
bucket 12
sidewalls 14, 16
front edges 17
reinforcing plates 19
base portion is
upright portion 20
floor 22
upper portion 24
arms 26
teeth members 30
front edge 32
body portion 34
beveled edge 36
point 38
space 40
blade 42
upper surface 43
front edge 44
under surface 46
mounting system 50
lip 51
upper mounting plate 52
opening 53
mounting members 54
support gussets.55
receiving space 56
side walls 60
side cutter 6
gusset plates 64, 65
mounting plate 67
mounting rod 70
outer housing 72
lower section 74
body 75
space 77
threaded bolt 76
threaded port 78
padeye 80
ball joint 82
retaining piston 82A
port 83
gusset pin 84
bolt 84A
head 84B
nut 84C
post 85
base member 87
wear bushing 89
set screw 90
mounting bushing 91
grease fitting 92
nut 93
first transverse mounting slot 95
mounting slots 97, 99
bolts 101
second transverse mounting slot 103

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved excavating bucket, comprising:

a) a pair of sidewalls, a rear wall, a floor portion and an open front portion for receiving material thereinto;

b) a plurality of teeth members secured to the floor portion for digging into material to be excavated;

c) a finishing blade mounted to the bucket, the blade extending across a width greater than a width of the bucket opening, and having a forward edge for scraping;

d) a raised channel formed on an upper face of the blade for engaging a plurality of the teeth members;

e) means extending from outer edges of the blade for engaging a wall of the bucket, for defining an uninterrupted travelling space for material into the bucket; and f) adjustable mounting means extending between the bucket wall and the blade for allowing swivelling of the blade mounting means.

2. The excavating bucket in claim 1, wherein the means extending from outer edges of the blade to engage a wall of the bucket comprises a pair of tilted back side walls for directing material into bucket space.

3. The excavating bucket in claim 1, wherein the adjustable mounting means further comprise:

a) a first rod housing;

a lower rod body fitted within the rod housing;

c) a threaded member positioned within and extending the length of the rod housing;

d) a threaded port in the rod body for threadably receiving the threaded member, as the rod housing is rotated; and e) mounting means on the ends of the rod for mounting to a wall of the bucket and the blade, with the rod housing having a free rotating end to adjust to the distance between mounts, and providing a swivel means to secure the blade.

4. The excavating bucket in claim 3, further comprising a gusset plate secured to the blade to provide an attachment means for one end of the rod housing.

5. The excavating bucket in claim 1, wherein the blade is mounted to the bucket so that materials excavated can still be moved within bucket space.

6. An improved excavating bucket, of the type having a pair of sidewalls, a rear wall, a floor portion and an open front portion for receiving material thereinto , and a plurality of teeth members secured to the floor portion for digging into the material to excavated, such as soil; the improvement comprising:

a) a finishing blade adjustably mounted to the bucket, the blade extending across a width greater tan the width of the bucket opening, and having a forward edge for scraping;

b) a raised channel formed on an upper face of the blade for engaging a plurality of the teeth members;

c) means extending from outer edges of the blade for engaging a wall of the bucket, for defining an uninterrupted travelling space for material into the bucket; and d) mounting means extending between the bucket and the blade, to allow the blade to be mounted to the bucket, and to adjust to various bucket widths.

7. The excavating bucket in claim 6, wherein the blade is used as a finishing blade following the excavating process.

8. The excavating bucket in claim 6, wherein h blade is mounted to the bucket so that material excavated can still be moved within a bucket space.

9. An improved excavating bucket, comprising:

a) a pair of sidewalls, a rear wall, a floor portion and an open front portion for receiving material thereinto;

b) a plurality of teeth members secured to the floor portion for digging into the material;

c) a finishing blade mounted to the bucket, the blade extending across a width greater than a width of the bucket opening, and having a forward edge for scraping;

d) a raised channel formed on an upper face of the blade for engaging a plurality of the teeth members;

e) means extending form outer edges of the blade for engaging a wall of the bucket, for defining an uninterrupted travelling space for material into the bucket; and f) adjustable support members positioned between the blades and the bucket sidewalls to provide an adjustment means for stabilizing the blade on the bucket, said support members comprising:

i) a first rod housing;

ii) a lower rod body fitted within the rod housing;

iii) a threaded member positioned within and extending the length of the rod housing;

iv) a threaded port in the rod body for threadably receiving the treaded member, as the rod housing is rotated; and v) swivel mounting means on the extends of the rod for mounting to a wall of the bucket and the blade, with a portion of the rod housing rotating to adjust to the distance between the mounting means, and providing a means to secure the blade.

* * * * *